US011631373B1

(12) United States Patent
Chen et al.

(10) Patent No.: US 11,631,373 B1
(45) Date of Patent: Apr. 18, 2023

(54) METHOD OF CONTROLLING DISPLAY PANEL AND RELATED DISPLAY DRIVER CIRCUIT

(71) Applicant: NOVATEK Microelectronics Corp., Hsin-Chu (TW)

(72) Inventors: Hung-Hsiang Chen, Hsinchu (TW); Che-Ching Chang, Hsinchu County (TW); Huang-Chin Tang, Hsinchu County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/956,820

(22) Filed: Sep. 29, 2022

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2310/0297* (2013.01); *G09G 2310/08* (2013.01); *G09G 2320/0209* (2013.01)

(58) Field of Classification Search
CPC .. G09G 3/3233; G09G 3/3225; G09G 3/3291; G09G 3/20; G09G 3/3266; G09G 2310/08; G09G 2320/0295; G09G 2320/0233; G09G 2320/043; G09G 2320/045; G09G 2320/0209; G09G 2330/021
See application file for complete search history.

(56) References Cited

U.S. PATENT DOCUMENTS

2003/0016189 A1* 1/2003 Abe ..... G09G 3/20 345/55
2020/0335034 A1* 10/2020 Lee ..... G09G 3/3266

* cited by examiner

*Primary Examiner* — Dong Hui Liang
(74) *Attorney, Agent, or Firm* — Winston Hsu

(57) ABSTRACT

A method of controlling a display panel includes steps of: detecting a plurality of lines of display data to generate a detection result; determining whether to apply a general timing or a compensation timing to each of the lines of display data according to the detection result; allocating a first display line period for a first line of display data determined to be applied with the general timing; outputting at least one control signal to the display panel in the first display line period according to a length of the first display line period; allocating a second display line period for a second line of display data determined to be applied with the compensation timing; and outputting the at least one control signal to the display panel in the second display line period according to a length of the second display line period different from the first display line period.

30 Claims, 14 Drawing Sheets

METHOD OF CONTROLLING DISPLAY PANEL AND RELATED DISPLAY DRIVER CIRCUIT

BACKGROUND OF THE INVENTION

Field of the Invention

The present invention relates to a method of controlling a display panel and a related display driver circuit, and more particularly, to a method of controlling an organic light-emitting diode (OLED) panel and a related display driver circuit.

Description of the Prior Art

Organic light-emitting diodes (OLEDs), which are self-emissive display devices having the benefits of fast response, high luminance, low operating voltage and small size, are widely used in various display devices such as television screens, computer monitors, outdoor displays, and portable systems including mobile phones and handheld game consoles, etc. To control an OLED panel to display a video, a display driver circuit (e.g., a driver integrated circuit (IC)) usually provides emission control signals in addition to scan signals to drive the OLED panel to display.

FIG. 1 is a schematic diagram of a layout structure of an OLED panel 10. FIG. 1 shows an active area of the OLED panel 10 in which a pixel array having numerous OLED pixels are included. The OLED panel 10 may be controlled by a driver IC (not illustrated), which outputs emission/gate control clocks and start pulses to a gate-on-array (GOA) circuit of the OLED panel 10, and the GOA circuit correspondingly generates and outputs the control signals through emission/gate control lines. The horizontal control lines GOA_1-GOA_M shown in FIG. 1 refer to the emission control lines and/or the gate control lines for controlling the emission of each OLED pixel. The driver IC may also output display data voltages to the OLED pixels through vertical data lines S_1-S_N.

In addition, the power line for delivering a power supply voltage ELVDD may be deployed throughout the OLED panel 10 to supply the power supply voltage ELVDD to all OLED pixels. As shown in FIG. 1, the power line and the data lines S_1-S_N overlap to a considerable extent, therefore generating non-ignorable capacitive coupling between the lines (called line crosstalk), such that the voltage variations on the data lines S_1-S_N will influence the power supply voltage ELVDD on the power line, and the variations of the power supply voltage ELVDD will also be coupled to the data lines S_1-S_N. The coupling effects may generate unwanted lines on the display image.

FIG. 2 illustrates an exemplary picture shown on the OLED panel 10. The picture includes a large white area with a black bar starting from line N and ending at line M, where the black bar extends through most columns of pixels with a small gap at the right side. In general, the black image may be generated with a large data voltage, and the white image may be generated with a small data voltage. Therefore, on the lines N and M, there may be a great number of data lines having a large voltage variation toward the same direction. The voltage variation is coupled to the power line such that unwanted lines are shown at the lines N and M of the display image, as the areas marked by rectangles shown in FIG. 2.

Currently available solutions to handle the line crosstalk problem usually modify the display data on the positions where unwanted lines are expected to appear. However, an appropriate compensation value cannot be found easily due to various factors such as inconsistent capacitance coupling between the data lines and power lines on the panel, different driving capabilities of the power supply voltage delivered through the power line, and different compensation values required by different image patterns. Thus, there is a need to provide a novel compensation scheme for solving the line crosstalk problem.

SUMMARY OF THE INVENTION

It is therefore an objective of the present invention to provide a method of handling the line crosstalk problem on a display panel by adjusting the control timing of the display panel, so as to solve the abovementioned problems.

An embodiment of the present invention discloses a method of controlling a display panel. The method comprises steps of: detecting a plurality of lines of display data to generate a detection result; determining whether to apply a general timing or a compensation timing to each of the plurality of lines of display data according to the detection result; allocating a first display line period for a first line of display data among the plurality of lines of display data determined to be applied with the general timing; outputting at least one control signal to the display panel in the first display line period according to a length of the first display line period; allocating a second display line period for a second line of display data among the plurality of lines of display data determined to be applied with the compensation timing; and outputting the at least one control signal to the display panel in the second display line period according to a length of the second display line period. Wherein, the length of the second display line period is different from the length of the first display line period.

Another embodiment of the present invention discloses a display driver circuit for controlling a display panel. The display driver circuit comprises a pattern detector and a signal generator. The pattern detector is configured to detect a plurality of lines of display data to generate a detection result. The signal generator is configured to determine whether to apply a general timing or a compensation timing to each of the plurality of lines of display data according to the detection result; allocate a first display line period for a first line of display data among the plurality of lines of display data determined to be applied with the general timing; output at least one control signal to the display panel in the first display line period according to a length of the first display line period; allocate a second display line period for a second line of display data among the plurality of lines of display data determined to be applied with the compensation timing; and output the at least one control signal to the display panel in the second display line period according to a length of the second display line period. Wherein, the length of the second display line period is different from the length of the first display line period.

These and other objectives of the present invention will no doubt become obvious to those of ordinary skill in the art after reading the following detailed description of the preferred embodiment that is illustrated in the various FIGS. and drawings.

DETAILED DESCRIPTION

Figure 1:
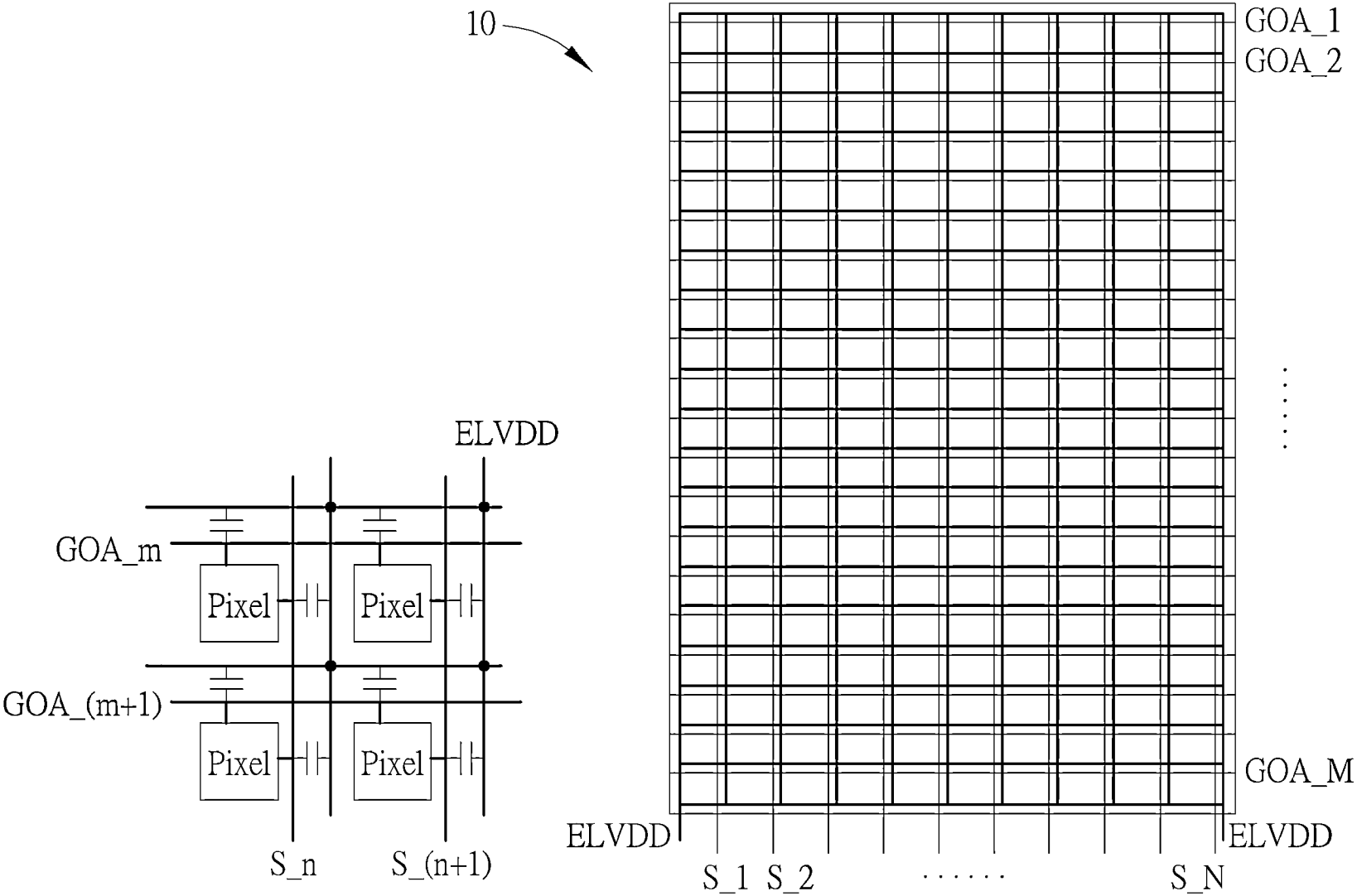
FIG. 1 PRIOR ART
FIG. 1 is a schematic diagram of a layout structure of an OLED panel.
Figure 2:
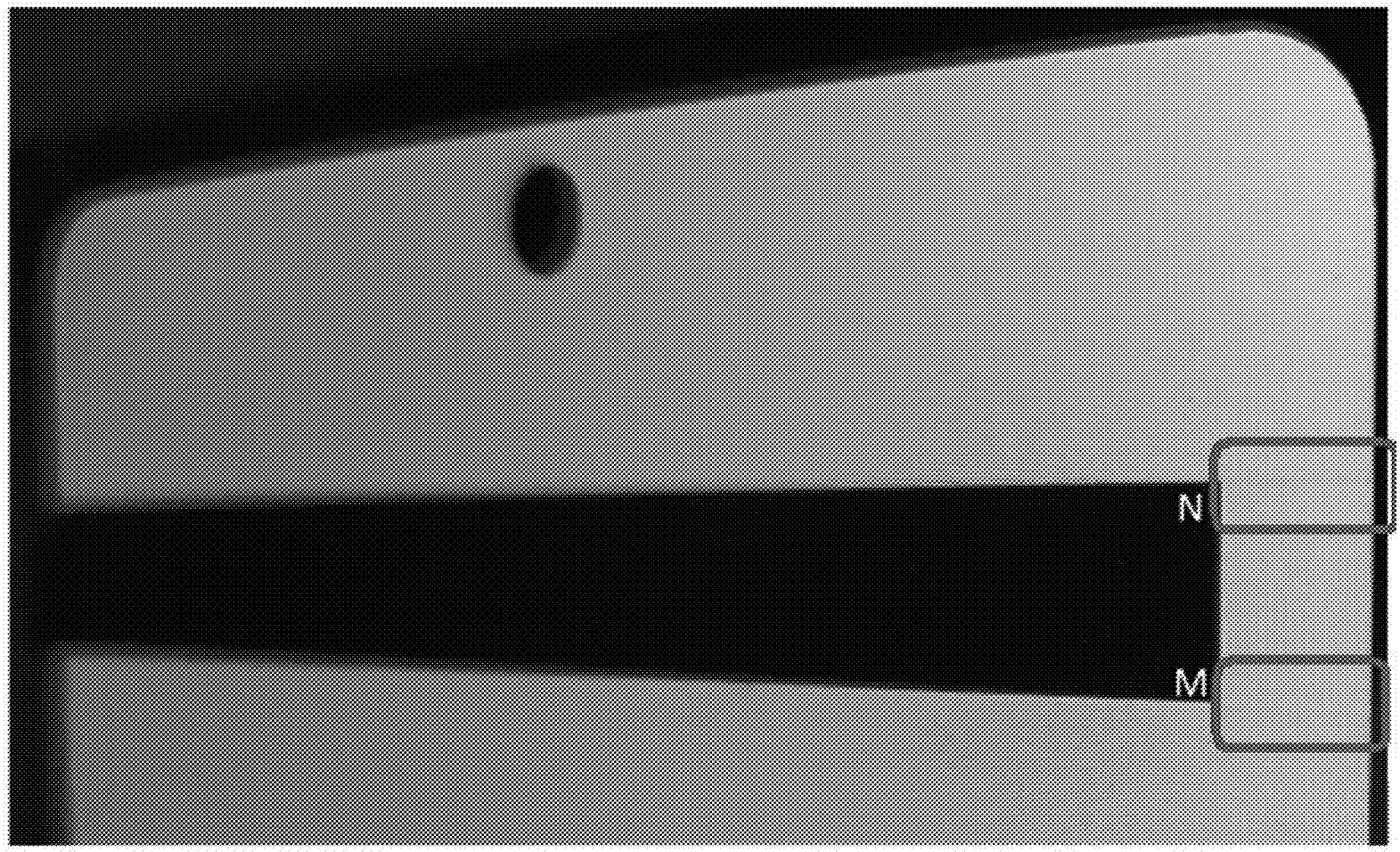
FIG. 2 PRIOR ART
FIG. 2 illustrates an exemplary picture shown on the OLED panel.
Figure 3:
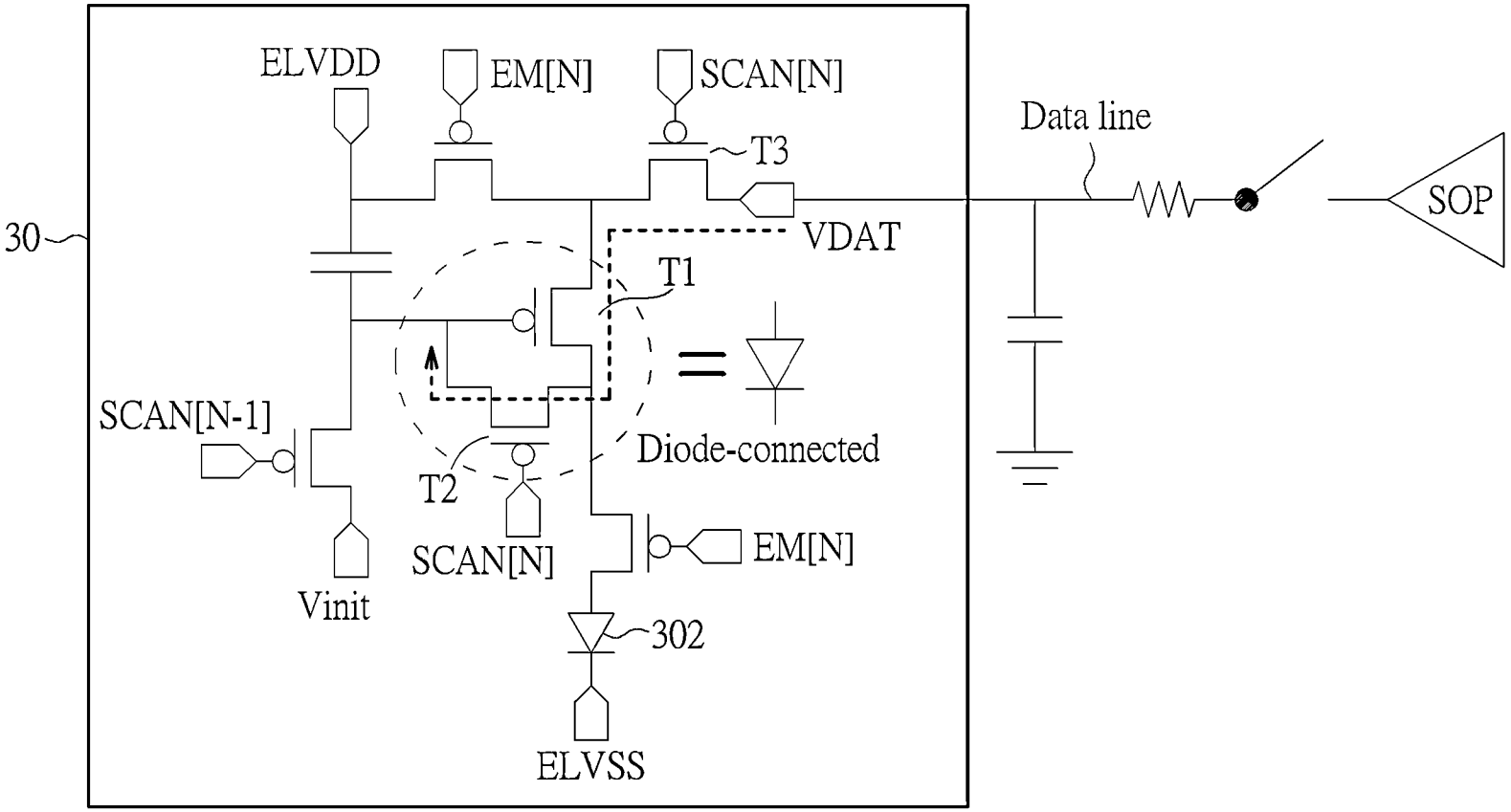
FIG. 3 is a schematic diagram of an exemplary structure of an OLED pixel in an OLED panel.

FIG. 3 is a schematic diagram of an exemplary structure of an organic light-emitting diode (OLED) pixel 30 in an OLED panel. As shown in FIG. 3, the OLED pixel 30 has an OLED 302 and a plurality of transistors, which is operated by receiving power supply voltages ELVDD and ELVSS, an emission control signal EM[N], scan signals (also called gate control signals) SCAN[N] and SCAN[N–1], an initial voltage Vinit, and a data voltage VDAT. The data voltage VDAT may be received from a source operational amplifier (SOP) of a display driver circuit through a data line. These control signals are received in an appropriate sequence to realize internal compensation of the OLED pixel 30.

When the data voltage VDAT is received by the OLED pixel 30, the transistors T1 and T2 form a diode-connected structure to generate a current flowing through the OLED 302. The brightness of the OLED 302 is determined based on the current magnitude, which corresponds to the source-to-gate voltage of the driving transistor T1. In general, in a display line period, multiple data voltages may be simultaneously output to a row of OLED pixels through multiple data lines on the OLED panel, and the voltage variations on the data lines may be coupled to the power line for delivering the power supply voltage ELVDD, such that the source-to-gate voltage of the driving transistor T1 may be interfered with by the voltage variations on the power supply voltage ELVDD. Sometimes the data line may not be fully charged to the target level corresponding to the data voltage VDAT during the display line period due to the interferences of the power supply voltage ELVDD. In such a situation, the source-to-gate voltage of the driving transistor T1 may not reach its target level, causing that the light intensity emitted by the OLED 302 may be deviated from its target brightness, thereby generating unwanted lines on the display image.

Figure 4:
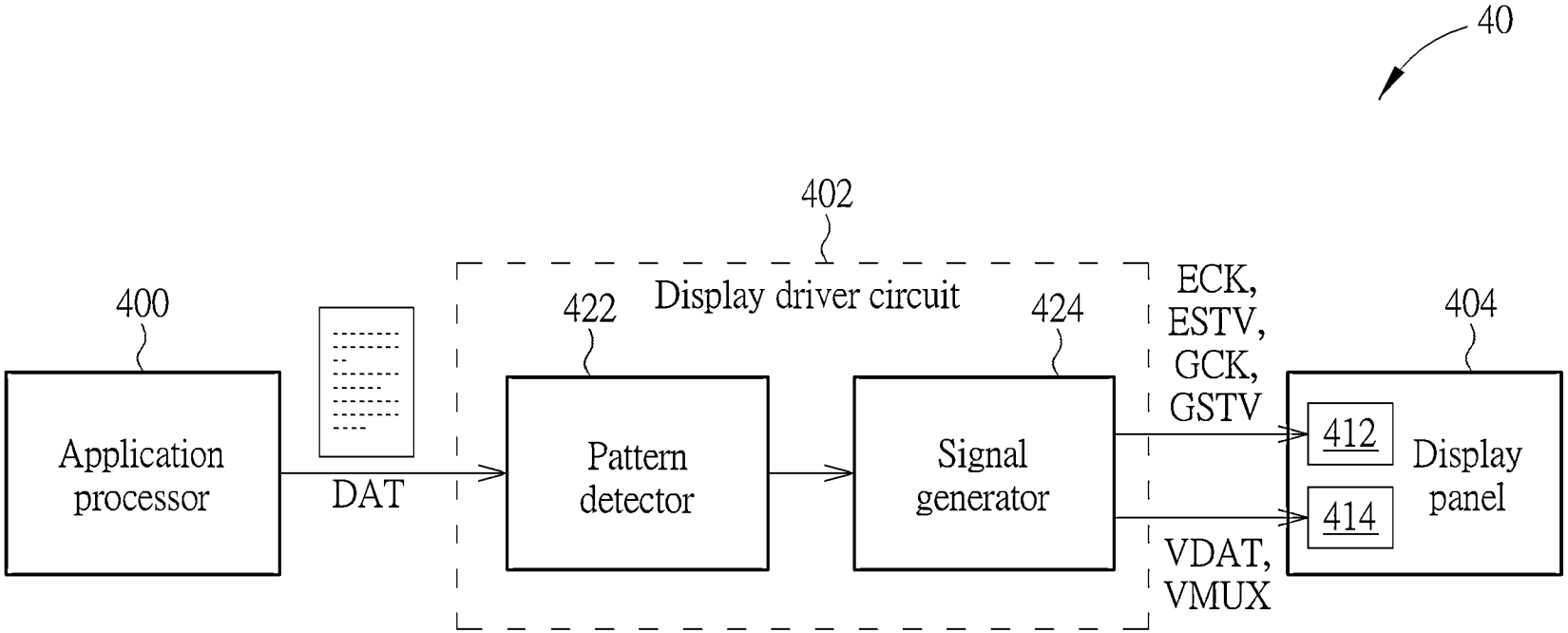
FIG. 4 is a schematic diagram of a display system according to an embodiment of the present invention.

FIG. 4 is a schematic diagram of a display system 40 according to an embodiment of the present invention. The display system 40 includes an application processor (AP) 400, a display driver circuit 402 and a display panel 404. The AP 400 may be an image provider such as a main processing circuit implemented with an application program which may generate image content to be displayed on the display panel 404. The display driver circuit 402 may be a source driver capable of outputting data voltages VDAT to the display panel 404, to drive the display panel 404 to show a desired image, where the data voltages VDAT are generated based on the display data DAT provided from the AP 400. In an embodiment, the display driver circuit 402 may be implemented in an integrated circuit (IC) as a display driver IC (DDIC). The display panel 404 may be an OLED panel having a great number of OLED pixels capable of converting the data voltages VDAT into driving currents to control the OLEDs to emit light, such as the OLED pixel 30 shown in FIG. 3. In another embodiment, the display panel 404 may be any other type of self-emissive display panel such as a mini-LED panel or a micro-LED panel, but not limited thereto.

As shown in FIG. 4, the display panel 404 may include a gate-on-array (GOA) circuit 412. The display driver circuit 402 may output several control signals to the GOA circuit 412 to control the operations of the OLED pixels. Such control signals include, but not limited to, an emission control clock ECK, an emission start pulse ESTV, a gate control clock GCK and a gate start pulse GSTV. The GOA circuit 412 may generate and output emission control signals to each OLED pixel according to the emission control clock ECK and the emission start pulse ESTV, and generate and output scan signals to each OLED pixel according to the gate control clock GCK and the gate start pulse GSTV.

In an embodiment, the display panel 404 may further include a multiplexer (MUX) circuit 414, which is coupled between the display driver circuit 402 and the data lines on the display panel 404. The MUX circuit 414 may include multiple switches used for switching an output of the display driver circuit 402 between multiple data lines, so that data voltages VDAT may be output to different data lines through the same output terminal time-divisionally. The display driver circuit 402 may output MUX control signals VMUX to control the switches of the MUX circuit 414, allowing the data voltages VDAT to be delivered to their target data lines appropriately.

The display driver circuit 402 includes a pattern detector 422 and a signal generator 424. The pattern detector 422 may detect the display data DAT to generate a detection result. The detection result may indicate that the signal generator 424 should generate and output the control signals based on a general timing or compensation timing. For example, the pattern detector 422 may detect each line of display data DAT to determine whether to output the control signals for this line of display data DAT by using the general timing or compensation timing. In the general timing, the signal generator 424 may allocate a general display line period for this line of display data, and output the control signals such as the emission control clock ECK, the gate control clock GCK and/or the MUX control signals VMUX based on the timing allocation of the general display line period. In the compensation timing, the signal generator 424 may allocate a compensation display line period for this line of display data, where the length of the compensation display line period may be different from the length of the general display line period, and for example, it might be longer than the length of the general display line period. For example, in the compensation display line period, the signal generator 424 may generate and output the control signals based on its longer length.

Figure 5:
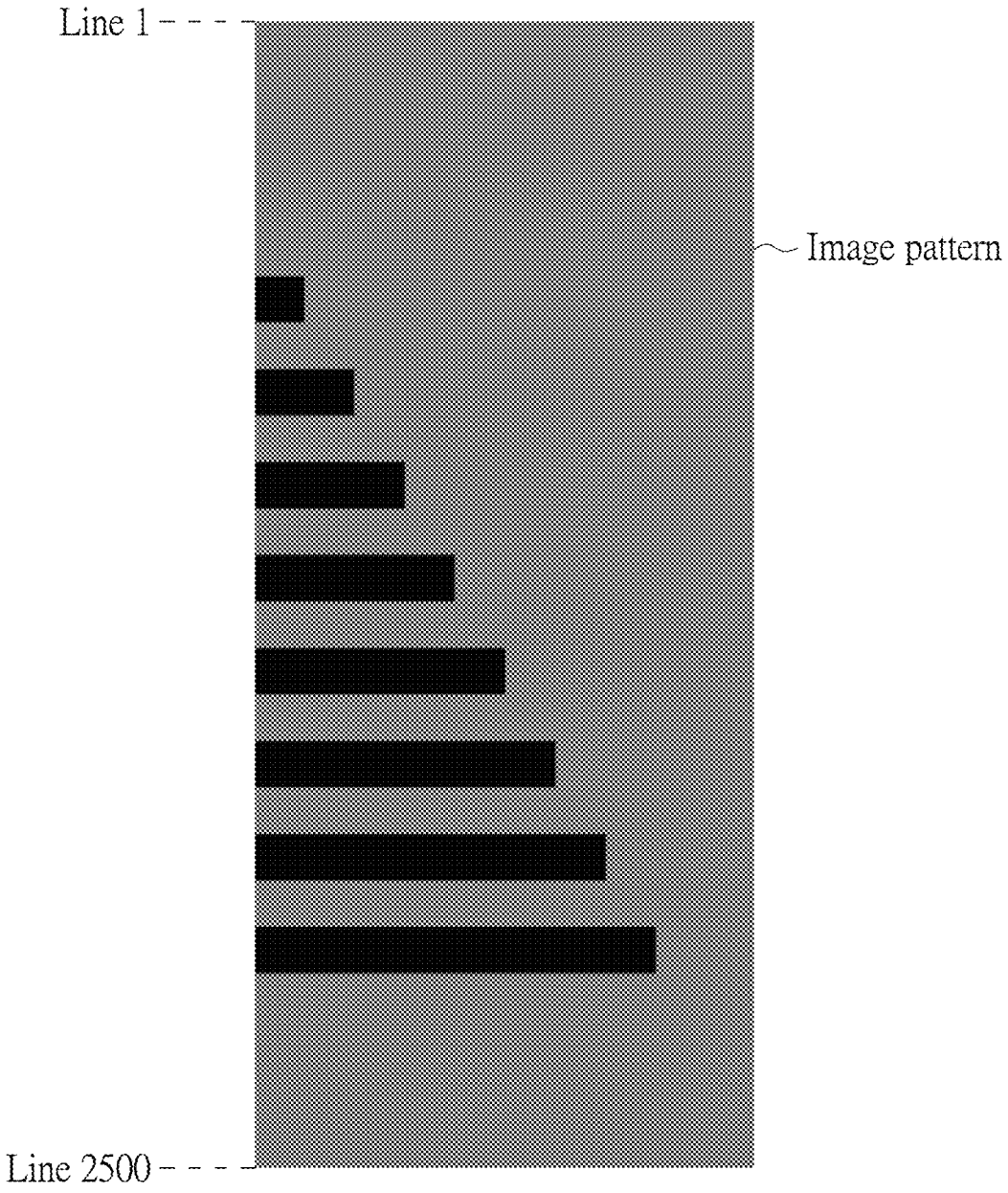
FIG. 5 illustrates an exemplary image pattern to be shown on the display panel.

As mentioned above, unwanted lines may appear at the positions where large voltage variations of a great number of data lines are coupled to the power line. Since a line of data voltages maybe output to the data lines simultaneously, the detection of the pattern detector 422 may be performed line by line (e.g., row by row). FIG. 5 illustrates an exemplary image pattern to be shown on the display panel 404. The image pattern includes several thick and black bars, and the coupling of voltage variations may easily appear at the edge of the black bars. Therefore, as for the line data at the edge of the black bars, the display driver circuit 402 may allocate the compensation display line period and output the control signals accordingly, where the compensation display line period might be longer than the general display line period used for other line data.

Based on the image pattern, the pattern detector 422 may detect the large voltage coupling by various methods. In an embodiment, the pattern detector 422 may calculate the data difference to determine whether the data difference between adjacent lines of display data may cause large voltage coupling that may interfere with the power supply voltage ELVDD. For example, when receiving a line of display data, the pattern detector 422 may calculate the data difference of this line of display data and its adjacent line of display data (e.g., the previous line of display data). If the overall data difference is greater than a threshold, the pattern detector 422 may determine that the compensation timing should be applied to this line of display data and provide the corresponding information for the signal generator 424. Alternatively, the pattern detector 422 may output a detection result associated with the data difference to the signal generator 424, so that the signal generator 424 may determine that the compensation timing should be applied when the detection result indicates that the overall data difference is greater than a threshold.

Otherwise, if the overall data difference is smaller than the threshold, the pattern detector 422 may determine that the general timing should be applied to this line of display data and provide the corresponding information for the signal generator 424, or output a detection result so that the signal generator 424 may determine that the general timing should be applied to this line of display data based on the detection result.

For example, the display data for calculating the data difference may be the original grayscale data received by the display driver circuit 402 or a brightness value converted from the original grayscale data. In one embodiment, the entire line of display data may be summed up to calculate the overall data difference that might interfere with the power supply voltage or OLED current.

Note that the coupling on the power line is generated from the voltage variations of the data lines; hence, the pattern detector 422 may determine whether to apply the general timing or compensation timing by detecting the voltage variations on the data lines. For example, the compensation timing may be applied to a line of display data if the voltage variation generated by this line of display data is greater than a threshold. The abovementioned threshold for the data difference or voltage variation may be set to an appropriate value and/or adjusted appropriately.

Figure 6:
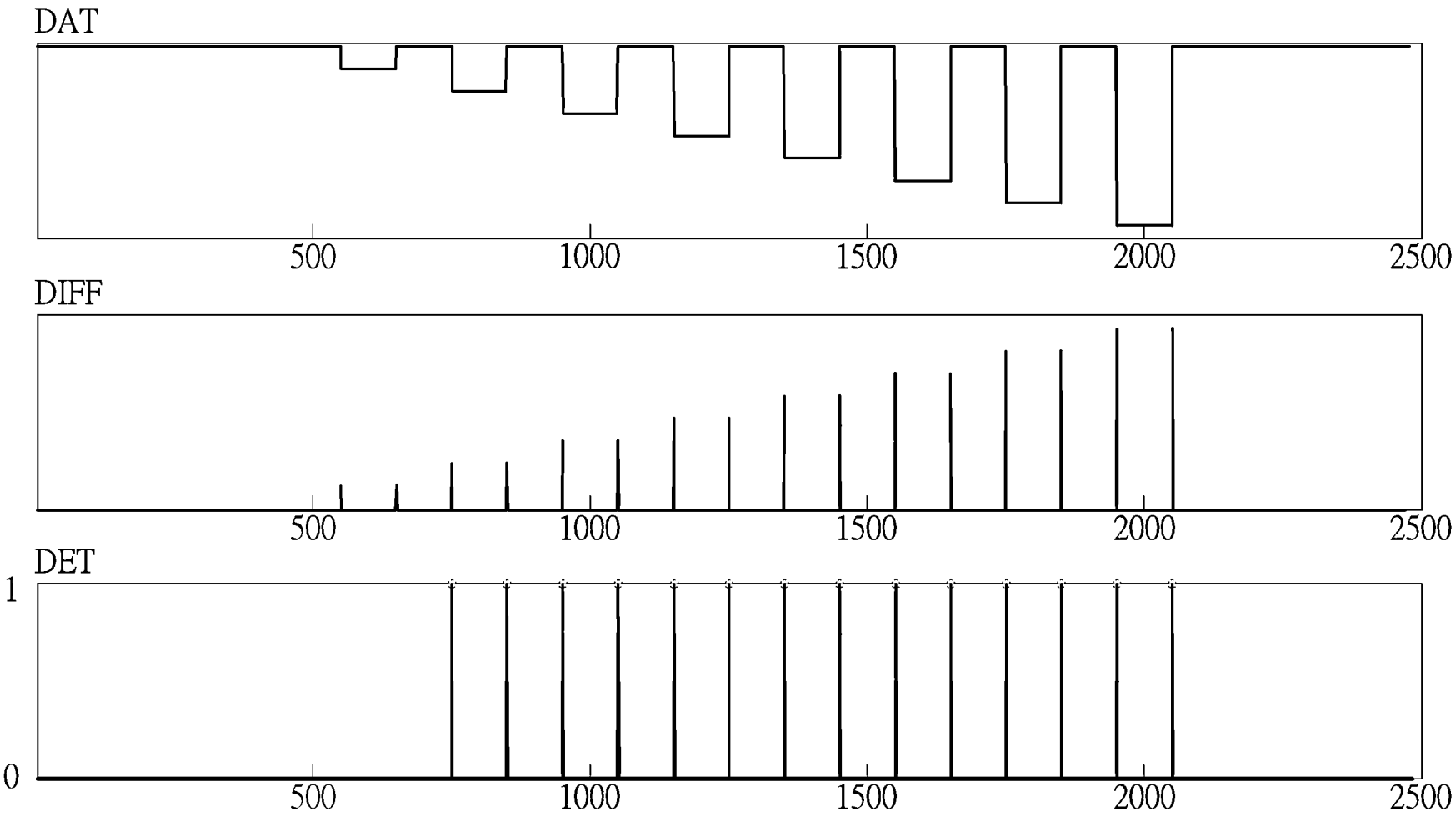
FIG. 6 is a waveform diagram illustrating the detection of display data for the image pattern shown in FIG. 5.

FIG. 6 is a waveform diagram illustrating the detection of display data for the image pattern shown in FIG. 5. Supposing that there are 2500 lines of pixels in the image pattern to be shown on the display panel, the display data DAT, data difference DIFF and corresponding detection result DET for 2500 lines of display data of the 2500 lines of pixels are illustrated. As shown in FIG. 5 and FIG. 6, the black area in FIG. 5 has a lower data value while the gray area in FIG. 5 has a higher data value. The display data DAT shown in FIG. 6 indicates the summation of data values of each line of display data, where a lower value of the display data DAT corresponds to a longer black bar in FIG. 5. The data difference DIFF refers to the difference of the display data DAT of every two adjacent lines of display data. It can be seen that higher values of the data difference DIFF appear at the edge of the black bars, and a longer black bar may generate a larger data difference DFF. The detection result DET may be a digital signal indicating that the compensation timing should be applied, where the value of the detection result DET equals 1 if the data difference DIFF exceeds a threshold.

Figure 7:
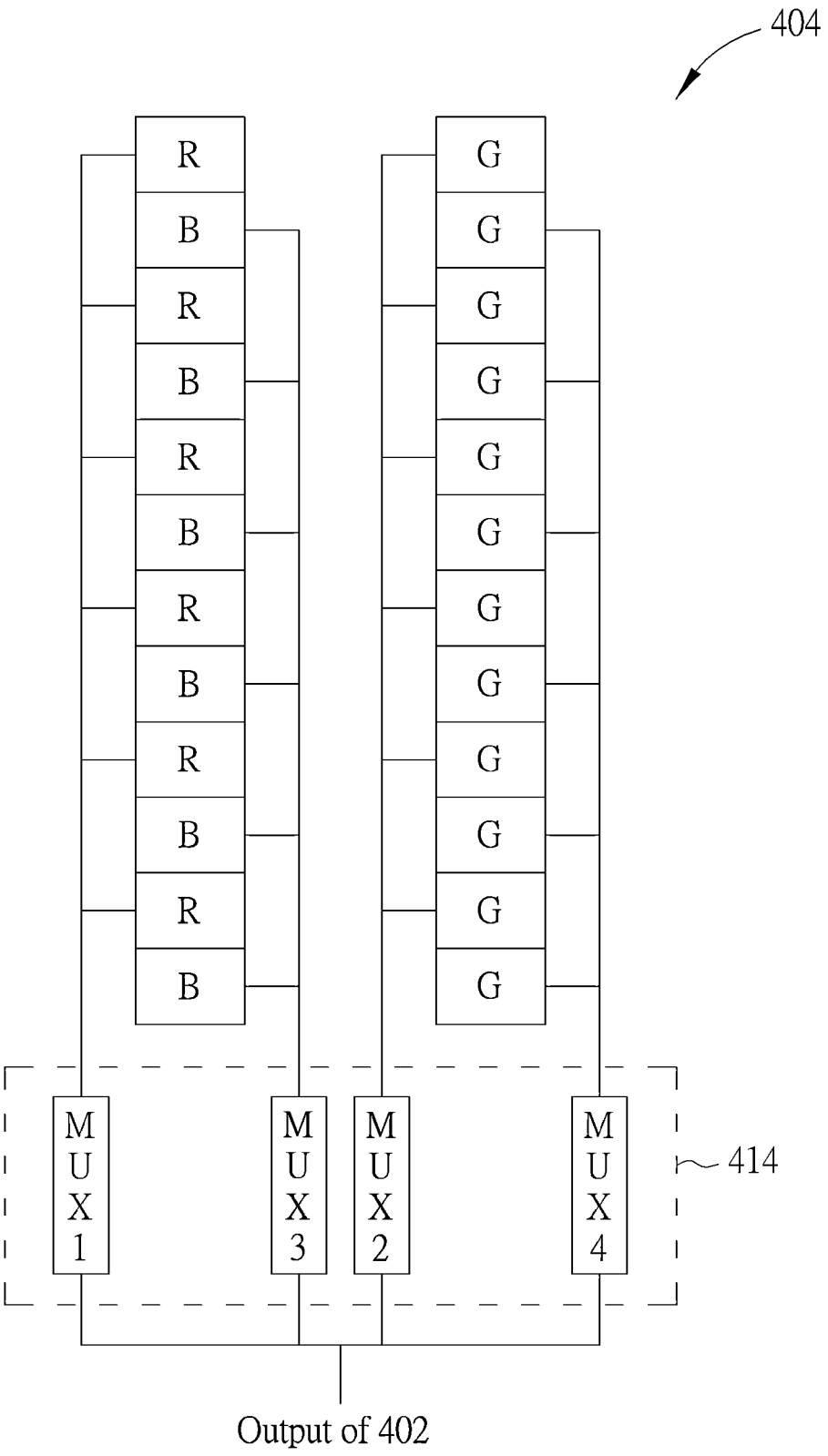
FIG. 7 is a schematic diagram of the display panel having the DDL structure.

In an embodiment, the MUX circuit 414 of the display panel 404 may be implemented as the dual data line (DDL) structure, where each column of subpixels are controlled by two data lines respectively coupled to two switches of the MUX circuit 414, as shown in FIG. 7. In this embodiment, a column of subpixels have red subpixels (R) and blue subpixels (B) deployed alternately, and another column of subpixels have green subpixels (G). An output terminal of the display driver circuit 402 may be coupled to four switches MUX1-MUX4 of the MUX circuit 414. FIG. 7 merely shows one channel having four switches MUX1-MUX4 and two columns of subpixels, but one of ordinary skill in the art should understand that there may be a great number of columns of pixels or subpixels on the display panel 404 and corresponding switches having the same structure included in the MUX circuit 414.

Figure 8:
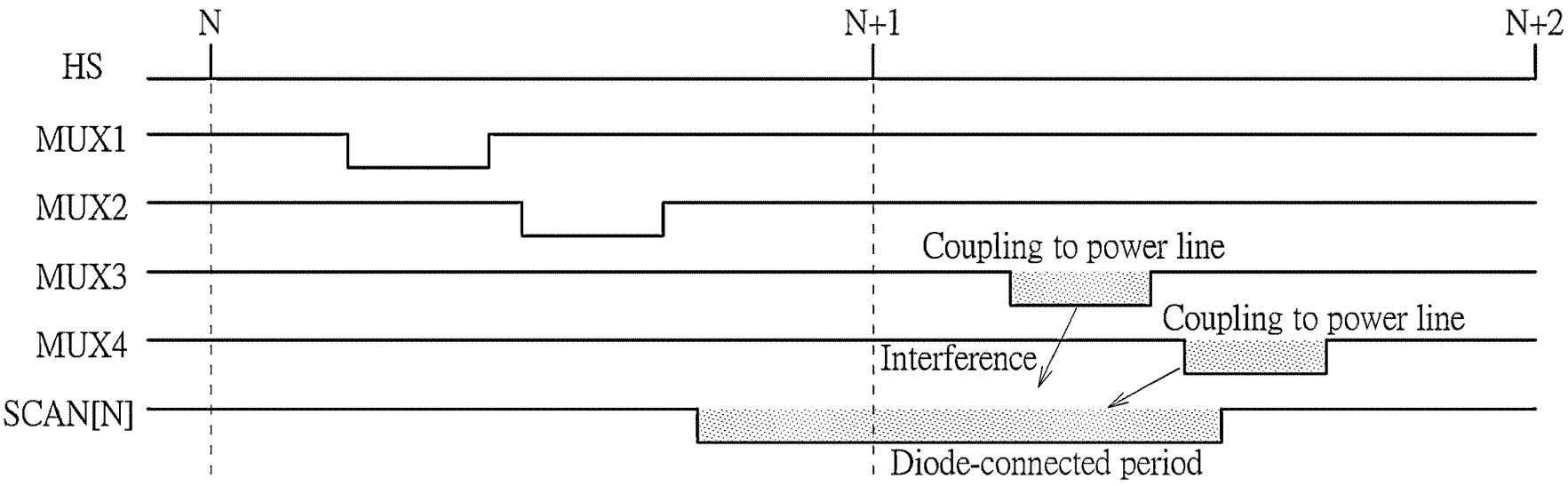
FIG. 8 is a waveform diagram of a general timing applied to the display panel.

FIG. 8 is a waveform diagram of a general timing applied to the display panel 404. FIG. 8 illustrates several control signals for lines N and N+1 of display data, where the control signals for the switches MUX1-MUX4, the scan signal SCAN[N] for line N, and the horizontal synchronization signal HS are shown. In this embodiment, the control signals for the switches MUX1-MUX4 and the scan signal SCAN[N] are low active, where the corresponding switches and transistors are turned on by the signals in "low" level, but one of ordinary skill in the art should understand that the implementation of control signals is not limited thereto.

As shown in FIG. 8, in the display line period for line N, the switches MUX1 and MUX2 are turned on sequentially, allowing the corresponding data voltages to be delivered to their target data lines and stored in the parasitic capacitors of the data lines. Subsequently, the scan signal SCAN[N] turns on the gate control switch in the pixels (or subpixels), such as the transistors T2 and T3 shown in FIG. 3. Therefore, the data voltage stored on the corresponding data line maybe input to the pixel, and the transistors T1 and T2 form the diode-connected structure to generate a current which flows through the diode 302, thereby driving the diode 302 to emit light. In order to allow the electric charges of the data voltage to be fully input to the pixel, the scan signal SCAN[N] may keep low and the transistors T2 and T3 may keep on for a longer time, which extends to the next display line period for line N+1 where the switches MUX3 and MUX4 are turned on. When the switches MUX3 and MUX4 are turned on, the data voltages may be delivered to the corresponding data lines to change the voltage levels of the data lines.

If the data difference of this line of display data is excessively large, the voltage variations of the data lines coupled to the switches MUX3 and MUX4 may easily be coupled to the power line to interfere with the diode-connected behavior of the pixels, thereby influencing the light emission of the pixels, such that unwanted lines may appear on the display image. In order to solve this problem, the scan signal SCAN[N] maybe controlled to have a shortened turn-on pulse.

Figure 9:
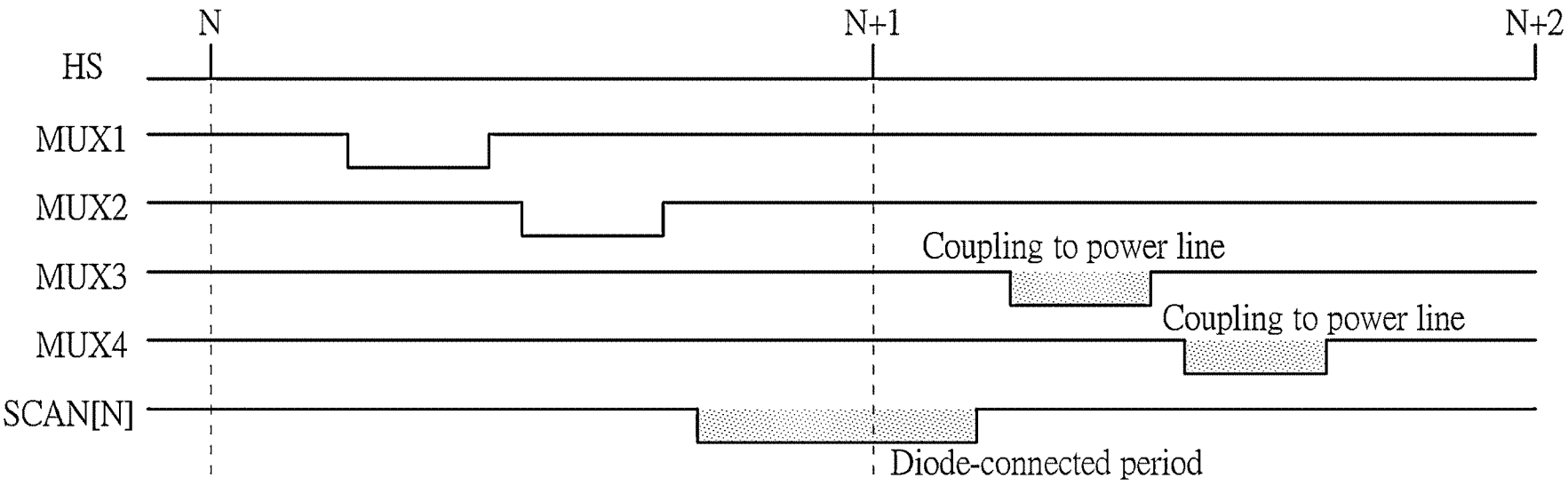
FIG. 9 is a waveform diagram of a compensation timing according to an embodiment of the present invention.

FIG. 9 is a waveform diagram of a compensation timing according to an embodiment of the present invention. In the compensation timing, the scan signal SCAN[N] has a shortened turn-on pulse in the scan operation for line N. The shortened turn-on pulse ends before the switches MUX3 and MUX4 are turned on; that is, the shortened turn-on pulse of the scan signal SCAN[N] may not overlap the on-time of the switches MUX3 and MUX4. Therefore, the voltage variations on the data lines coupled to the switches MUX3 and MUX4 may not change during the diode-connected period of the pixels in line N, and thus the diode-connected behavior of the pixels may not be interfered with by the voltage variations of the data lines.

In an embodiment, if the pattern detector 422 determines that the voltage variation or data difference caused by the $N^{th}$ line of display data is lower than a threshold, the signal generator 424 may output the gate control clock GCK to control the GOA circuit 412 to generate the general turn-on pulse in the scan signal SCAN[N] as shown in FIG. 8. Otherwise, if the pattern detector 422 determines that the voltage variation or data difference caused by the $N^{th}$ line of display data exceeds the threshold, the gate control clock GCK output by the signal generator 424 may be modified or adjusted, so as to control the GOA circuit 412 to generate the shortened turn-on pulse in the scan signal SCAN[N] as shown in FIG. 9.

Figure 10:
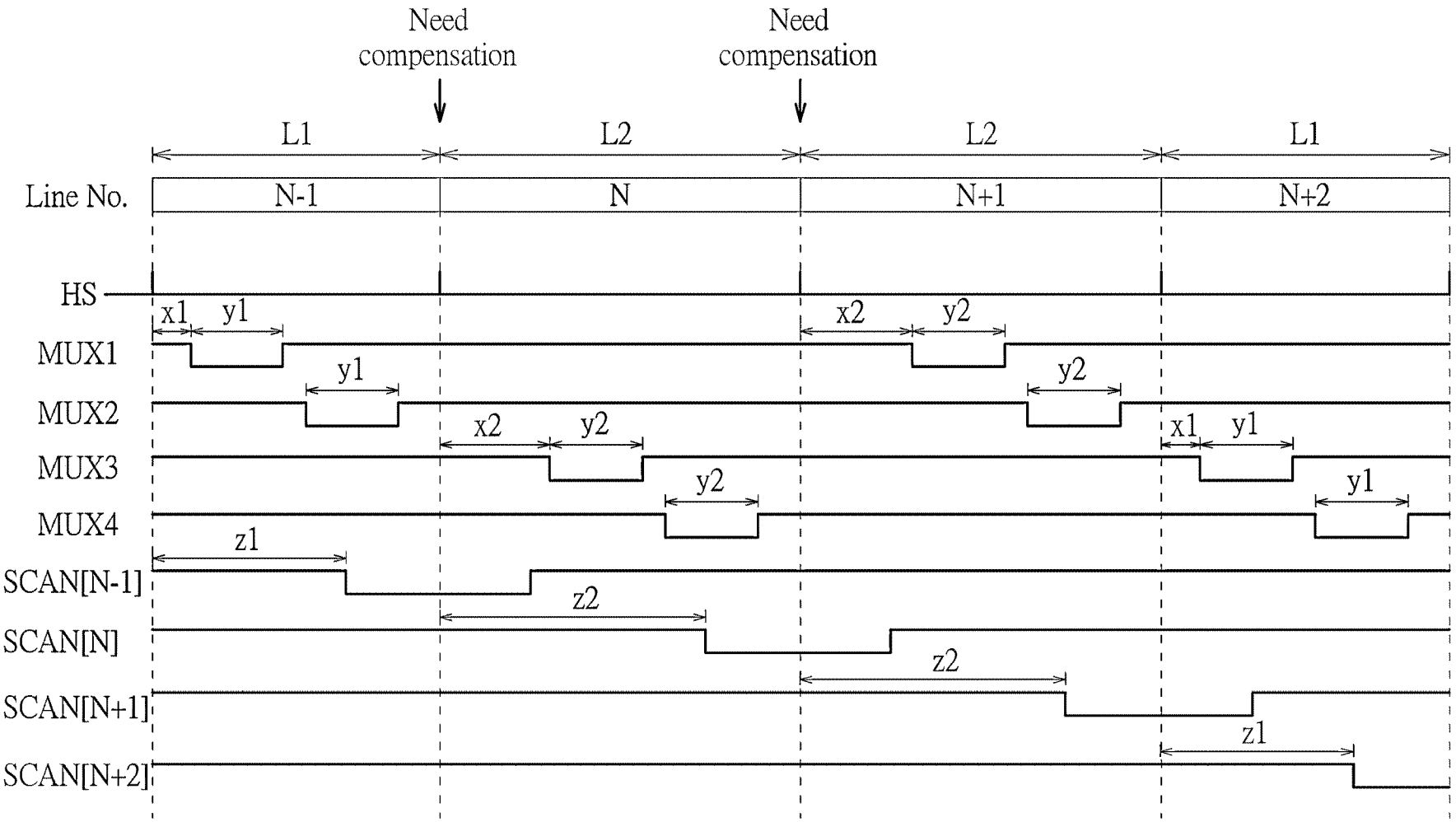
FIG. 10 is a waveform diagram of signals for controlling a display panel according to an embodiment of the present invention.

In another embodiment, the display line period for a line of display data may be extended, so that the display line period may include a longer time to allocate the scan signals and the MUX control signals appropriately. FIG. 10 is a waveform diagram of signals for controlling a display panel (such as the OLED panel with the DDL structure as shown in FIG. 7) according to an embodiment of the present invention. FIG. 10 illustrates the waveforms of the horizontal synchronization signal HS, the control signals for the switches MUX1-MUX4, and the scan signals SCAN[N−1], SCAN[N], SCAN[N+1] and SCAN[N+2] for four consecutive lines N−1, N, N+1, N+2 of display data in the same frame period.

Suppose that the detection result of the pattern detector 422 indicates that lines N and N+1 have an excessive data difference and/or voltage variation and thus need the compensation timing, while lines N−1 and N+2 are applied with the general timing. Under the general timing, the length of the display line period for each of the lines N−1 and N+2 is equal to L1. Under the compensation timing, the length of the display line period for each of the lines N and N+1 is equal to L2, which is longer than the length L1. Therefore, the signal generator 424 of the display driver circuit 402 may output the control signals to the display panel 404 based on the length L1 or L2 in each display line period. For example, the signal generator 424 may output the gate control clock GCK and the gate start pulse GSTV to the GOA circuit 412, to generate the scan signals SCAN[N−1], SCAN[N], SCAN[N+1] and SCAN[N+2]. The signal generator 424 may also output the MUX control signals VMUX to the switches MUX1-MUX4 of the MUX circuit 414 under different lengths L1 and L2 of display line periods; hence, the turn-on pulse of the scan signal may not overlap the on time of the MUX switches under a longer display line period.

More specifically, since the display line period under the compensation timing is longer, the switches may be turned on later after the scan signal turns off the previous gate line, so as to prevent the on time of the MUX switches from overlapping the on time of the gate lines. As shown in FIG. 10, in the display line period for line N−1 where the general timing is applied, the switch MUX1 may be turned on with a delay time ×1 with respect to the start of the display line period for line N−1. In the next display line period for line N where the compensation timing is applied, the switch MUX3 may be turned on with a delay time ×2 with respect to the start of the display line period for line N. The delay time ×2 may be longer than the delay time ×1 , allowing the switch MUX3 to be turned on after the scan signal SCAN[N−1] turns off the gate line for the previous line N−1, so that the line crosstalk problem may be solved.

In addition, the pulse width of the MUX control signals may also be adjusted appropriately under the compensation timing. For example, as shown in FIG. 10, the widths of the turn-on pulses of the control signals for the switches MUX1 and MUX2 in the display line period for line N−1 where the general timing is applied are equal to y1, and the widths of the turn-on pulses of the control signals for the switches MUX3 and MUX4 in the display line period for line N where the compensation timing is applied are equal to y2. The pulse widths y1 and y2 may be equal or unequal. In an embodiment, the pulse width y2 may be longer than the pulse width y1 . The longer pulse width y2 increases the charging time for the data line, and thus the line crosstalk problem may be improved. In another embodiment, the pulse width of the control signal for the switch MUX1 maybe different from the pulse width of the control signal for the switch MUX2 in the same display line period, and/or the pulse width of the control signal for the switch MUX3 may be different from the pulse width of the control signal for the switch MUX4 in the same display line period.

Further, due to the extension of the display line period, the scan signals may also be delayed differently to be adapted to the compensation timing. For example, as shown in FIG. 10, the scan signal SCAN[N−1] turns on the corresponding gate line with a delay time z1 with respect to the start of the display line period for line N−1, and the scan signal SCAN[N] turns on the corresponding gate line with a delay time z2 with respect to the start of the display line period for line N. The delay time z2 may be longer than the delay time z1 to be adapted to the longer display line period under the compensation timing.

Please note that each of the timing parameters such as the delay times and pulse widths described above may be adjusted dependently or independently or may not be adjusted under different lengths of display line periods. As long as the display line periods in the same frame period have different lengths based on the detection results of data difference and/or voltage variation, the implementations should belong to the scope of the present invention regardless of how the control signals are output based on the lengths of the display line periods.

Please also note that the allocation of compensation timing in several display line periods may increase the overall time length of the display line periods in a frame period. In order to recover the original frame rate and make the frame rate consistent, the increase of these display line periods should be compensated in another time slot of the frame period. Further, if there are excessive lines applying the compensation timing, the extension of the display line periods may not be easily compensated in the frame period. The present invention also provides several methods to solve these problems.

Figure 11:
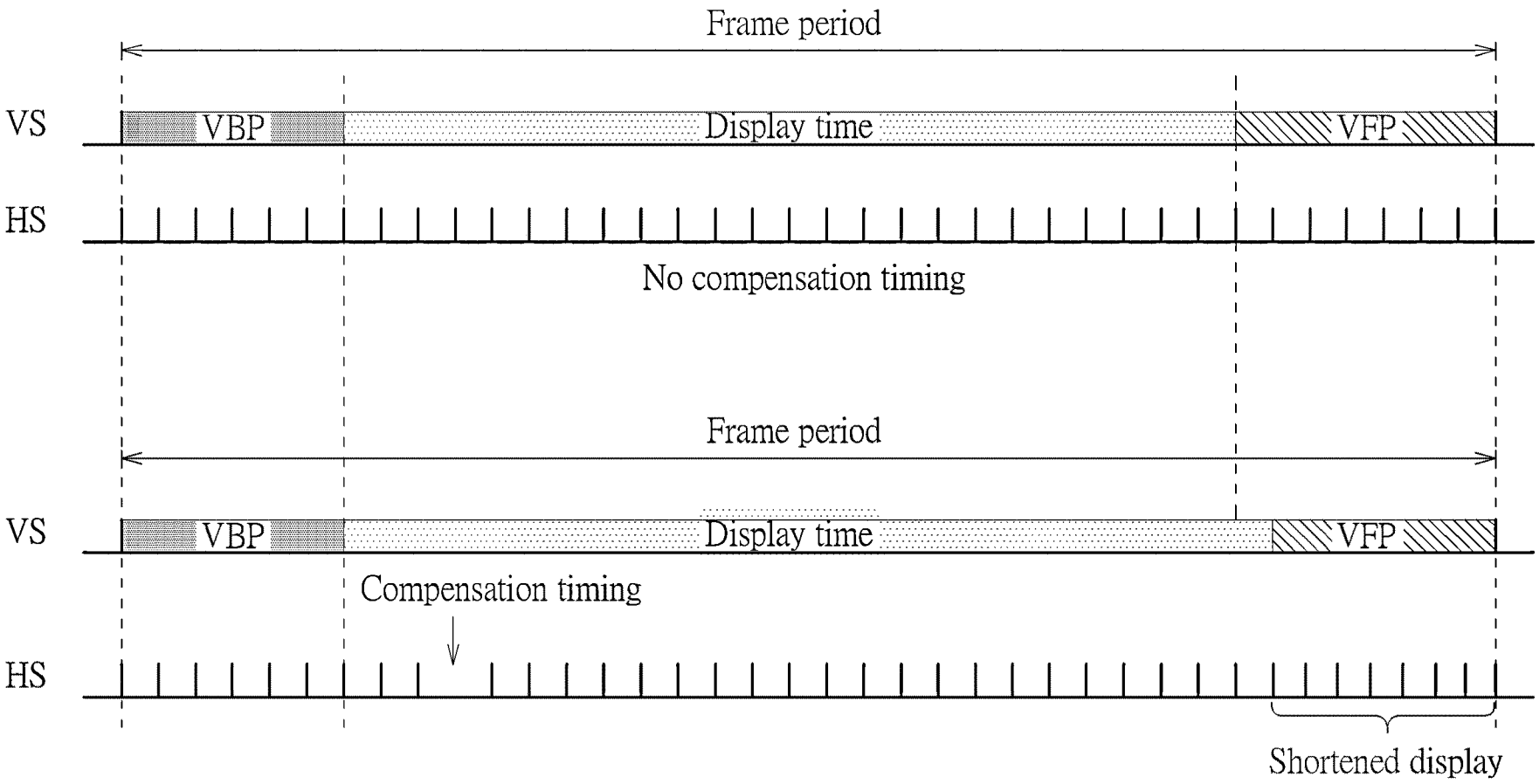
FIG. 11 is a waveform diagram of the allocation of display line periods in a frame period according to an embodiment of the present invention.

FIG. 11 is a waveform diagram of the allocation of display line periods in a frame period according to an embodiment of the present invention. The frame period is composed of a vertical back porch (VBP), a display time and a vertical front porch (VFP). FIG. 11 illustrates the waveforms of a vertical synchronization signal VS and a horizontal synchronization signal HS. A pulse of the vertical synchronization signal VS indicates a frame period, and a pulse of the horizontal synchronization signal HS indicates a display line period. When there is no compensation timing applied in the frame period, which means that all display line periods apply the general timing, the horizontal synchronization signal HS and the display line period may be allocated normally with equal length. When a compensation timing is applied and thus generates a longer display line period in the display time, there should be at least one other display line period having a shorter length (i.e., shorter than the display line period of the general timing) in the same frame period.

The shortened display line period(s) may be deployed in the VFP, as shown in FIG. 11. In this embodiment, each display line period in the VFP may be evenly shortened to compensate for the extended timing in the display line period determined to have excessively large data difference and/or voltage variation, so that the overall frame period may remain unchanged.

Please note that the control signals for controlling an OLED pixel include an emission control signal and a scan signal, which commonly control the operations of the OLED pixel with appropriate timing. To make the OLED pixel emit normally, the on time of the gate line should not overlap the emission time controlled by the emission control signal; that is, the turn-on pulse of the scan signal should be output when the emission control signal is "high" and turns off the emission function of the OLED pixel. Under the above compensation timing, the scan signals are delayed to be adapted to the extended display line period, while the emission control signals should not be adjusted or modified, in order to keep the overall brightness constant. The scan signals cannot be delayed too much to overlap the emission time, which results in a limitation on the number of display line periods that apply the compensation timing.

In such a situation, if the number of display line periods applying the compensation timing is excessive, the extension of display line periods may not be successfully compensated by using shortened display line periods in the VFP. In such a situation, the shortened display line periods may also be included in the display time. In an embodiment, the pattern detector 422 may detect that the data difference or voltage variation of one or several lines of display data is small and may not require too much charging/discharging time. Therefore, the shortened display line period may be allocated to the line(s) of display data.

Figure 12:
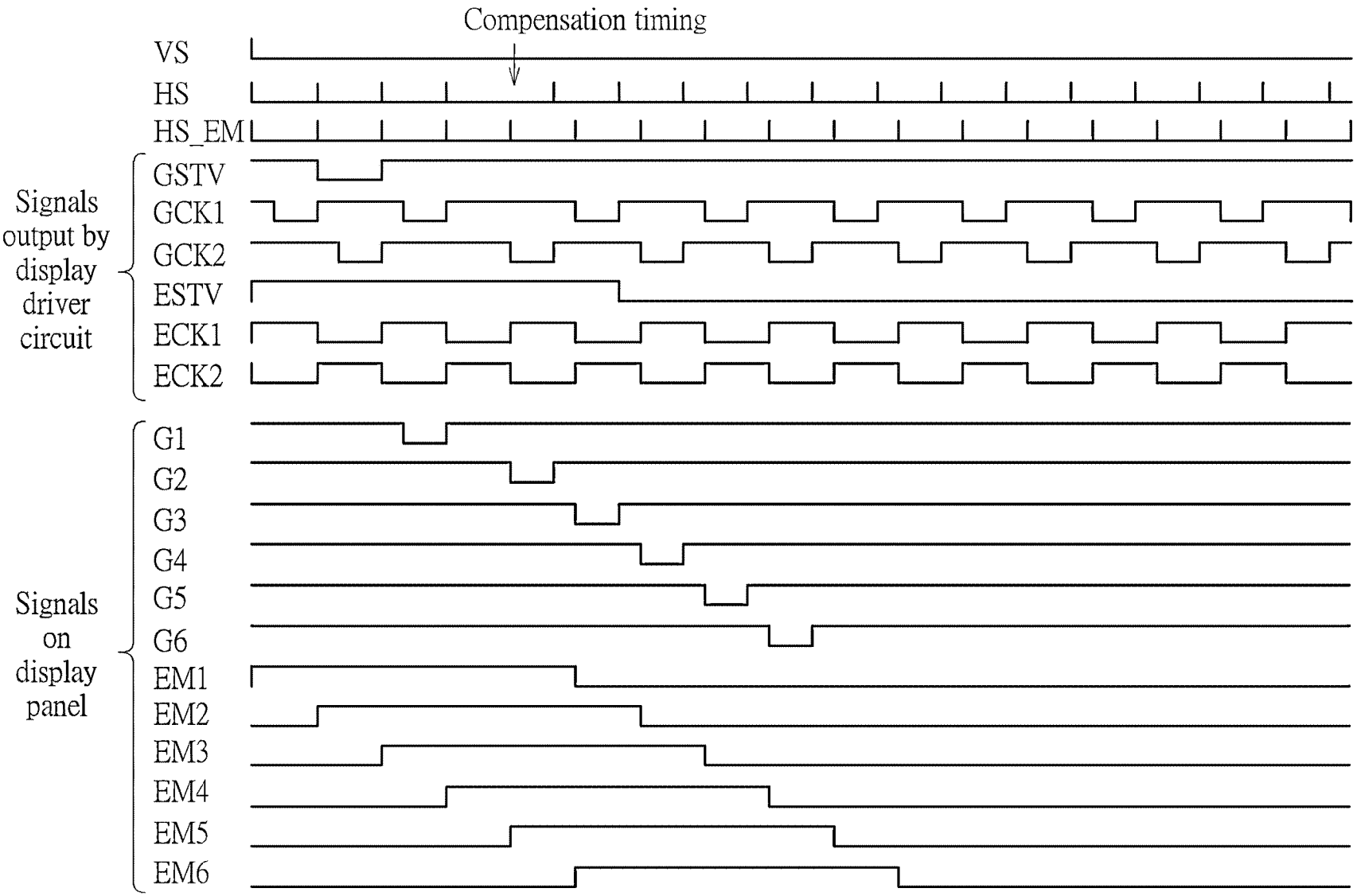
FIG. 12 is a waveform diagram of a frame period in which the emission control and gate control are performed independently according to an embodiment of the present invention.

In the compensation timing, since the scan signals are delayed without modifying the emission control signals, the emission control and gate control maybe performed independently. FIG. 12 is a waveform diagram of a frame period in which the emission control and gate control are performed independently according to an embodiment of the present invention. FIG. 12 illustrates several control signals output by the display driver circuit, several signals on the display panel, and other control signals such as a vertical synchronization signal VS, a horizontal synchronization signal HS and an emission horizontal synchronization signal HS_EM. In this embodiment, the horizontal synchronization signal HS is used to perform gate line control (or called scan control), and the emission horizontal synchronization signal HS_EM is used to perform emission control; hence, the gate line control and the emission control may be performed independently with the usage of different timing synchronization signals.

Similarly, a pulse of the vertical synchronization signal VS indicates a frame period. A pulse of the horizontal synchronization signal HS indicates a display line period, where a longer display line period is allocated by applying the compensation timing. In the emission horizontal synchronization signal HS_EM, the pulse interval is always constant, to ensure that the brightness of the display image will not be influenced by the variable display line periods.

The signals output by the display driver circuit include a gate start pulse GSTV, gate control clocks GCK1 and GCK2, an emission start pulse ESTV and emission control clocks ECK1 and ECK2. The gate start pulse GSTV and the gate control clocks GCK1 and GCK2 are output based on the control of the horizontal synchronization signal HS, for controlling the scan operations of the display panel. The emission start pulse ESTV and the emission control clocks ECK1 and ECK2 are output based on the control of the emission horizontal synchronization signal HS_EM, for controlling the emission operations of the display panel. As shown in FIG. 12, each pulse of the gate control clocks GCK1 and GCK2 may correspond to a display line period, and a longer display line period under the compensation timing may generate a pulse longer than other pulses under the general timing. In other words, the gate control clocks GCK1 and GCK2 may have an additional delay generated from the longer pulse interval of the horizontal synchronization signal HS. In contrast, the emission control clocks ECK1 and ECK2, as being controlled by the emission horizontal synchronization signal HS_EM, have a fixed clock cycle. Therefore, even if the display line periods have different lengths, the pulse widths of the emission control clocks ECK1 and ECK2 are always equal.

Note that the implementation of the gate control clocks GCK1 and GCK2 and the emission control clocks ECK1 and ECK2 is merely an exemplary embodiment of the present invention. In another embodiment, there may be only one gate control clock and/or only one emission control clock. Alternatively, more than two gate control clocks and/or more than two emission control clocks may also be feasible.

FIG. 12 also illustrates scan signals G1-G6 and emission control signals EM1-EM6, each of which is output to a line of OLED pixels from the GOA circuit of the display panel. The scan signals G1-G6 are generated based on the gate start pulse GSTV and the gate control clocks GCK1 and GCK2. The scan signal G2 and its subsequent scan signals are delayed due to the longer pulse width of the gate control clocks GCK1 and GCK2 under the compensation timing. The emission control signals EM1-EM6 are generated based on the emission start pulse ESTV and the emission control clocks ECK1 and ECK2. Since the emission control clocks ECK1 and ECK2 have a fixed clock cycle and pulse width, the duty cycle of each of the emission control signals EM1-EM6 will not change, thereby keeping the brightness of the display image constant.

As a result, according to the duty cycle of the emission control signals and also in consideration of the capability of allocating the shortened display line periods in the VFP, the number of lines of display data applied with the compensation timing in a frame period is limited. In an embodiment, the display driver circuit may calculate the number of lines of display data which need to apply the compensation timing, to determine whether the compensation timing is feasible in this frame period. In an embodiment, in order to allow the compensation timing more feasible, the duty cycle of the emission control signals maybe set to a lower value, to increase the possible number of lines of display data applied with the compensation timing in the frame period.

Figure 13:
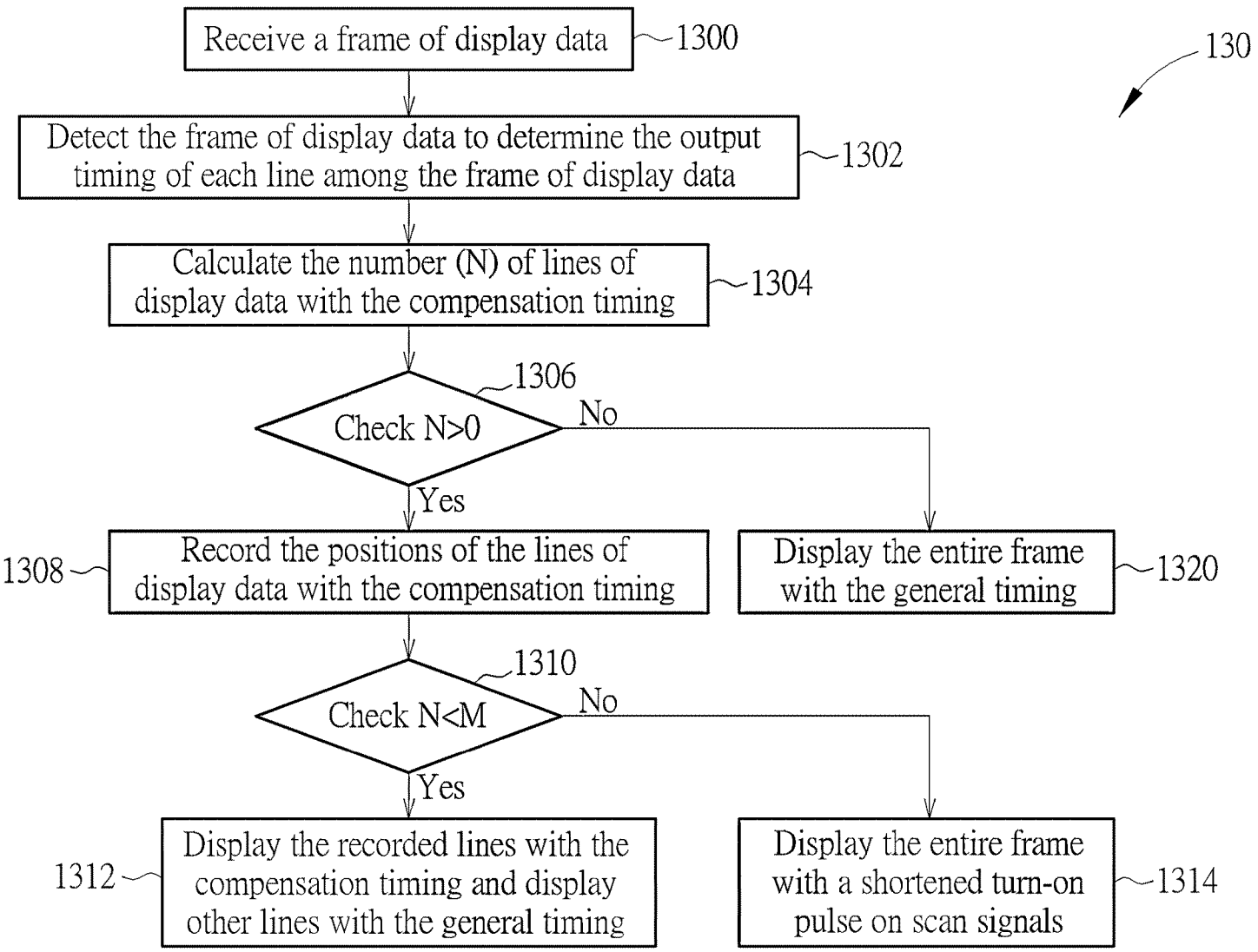
FIG. 13 is a flowchart of a process according to an embodiment of the present invention.

FIG. 13 is a flowchart of a process 130 according to an embodiment of the present invention. The process 130, which may be implemented in a display driver circuit for driving a display panel such as the display driver circuit 402 shown in FIG. 4, includes the following steps:

Step 1300: Receive a frame of display data.

Step 1302: Detect the frame of display data to determine whether to apply a general timing or a compensation timing to each line of display data among the frame of display data.

Step 1304: Calculate the number (N) of lines of display data determined to be applied with the compensation timing.

Step 1306: Determine whether there is at least one line of display data determined to be applied with the compensation timing (N>0). If yes, go to Step 1308; otherwise, go to Step 1320.

Step 1308: Record the positions of the lines of display data determined to be applied with the compensation timing.

Step 1310: Determine whether the number of lines of display data determined to be applied with the compensation timing is less than a threshold M (N<M). If yes, go to Step 1312; otherwise, go to Step 1314.

Step 1312: Display the recorded lines of display data by applying the compensation timing and display other lines of display data by applying the general timing.

Step 1314: Display the entire frame of display data with a shortened turn-on pulse on scan signals.

Step 1320: Display the entire frame of display data by applying the general timing.

According to the process 130, the display driver circuit may receive a frame of display data and detect the frame of display data to determine whether each line of display data should be applied with the compensation timing. The determination may be performed by detecting the data difference of adjacent lines of display data or detecting the voltage variation generated by each line of display data as described above. Subsequently, the display driver circuit may determine whether there is at least one line of display data determined to be applied with the compensation timing. If so, the position(s) of the line(s) of display data applied with the compensation timing is/are recorded.

Therefore, the display driver circuit may determine whether the number N of lines of display data determined to be applied with the compensation timing is less than a threshold M (i.e., to determine whether N<M). The compensation timing is performed when the number of lines of display data having the compensation timing does not exceed the threshold. As mentioned above, excessive lines having the compensation timing in one frame period may cause emission abnormalities or may not be successfully compensated through shortened timing of the VFP. Therefore, it is preferable to apply the compensation timing and extend the display line periods only when the number of lines of display data determined to be applied with the compensation timing is less than the predetermined upper limit.

As a result, the display driver circuit may control the display panel to display the recorded lines of display data with the compensation timing and display other lines of display data with the general timing. Alternatively, if there is no need for compensation timing, the display driver circuit may control the display panel to display the entire frame of display data with the general timing. Based on the output timing and the corresponding length of the display line period, the display driver circuit may output various control signals such as the MUX control signals and/or gate control clocks with an appropriate timing adapted to the length of the display line period.

In an embodiment, if the number of lines of display data determined to be applied with the compensation timing is greater than the threshold (i.e., N>M) , the display driver circuit may still apply the general timing to allocate the display line periods, while utilizing another scheme to solve the line crosstalk problem. For example, the display driver circuit may display the entire frame of display data by outputting the gate control clock GCK which generates a shortened turn-on pulse on the scan signals (Step 1314), such as the implementation shown in FIG. 9.

In an embodiment, the determination approaches may be performed on each frame of display data to generate a determination result. The display driver circuit may output the frame of display data with a specific timing based on the determination result after the determination process for this frame is completed. Alternatively, in order to reduce the processing delay or if the determination is based on the voltage variations detected on the data lines, the determination result for a currently received frame of display data may be applied to generate the output timing for the next frame of display data.

In the above embodiment, the display driver circuit may be equipped with a frame buffer to realize the frame-based process. In another embodiment, if the display data is transmitted in the video mode and/or if the display driver circuit does not have a frame buffer capable of storing the frame data, the display driver circuit may determine the output timing with a line-based process.

Figure 14:
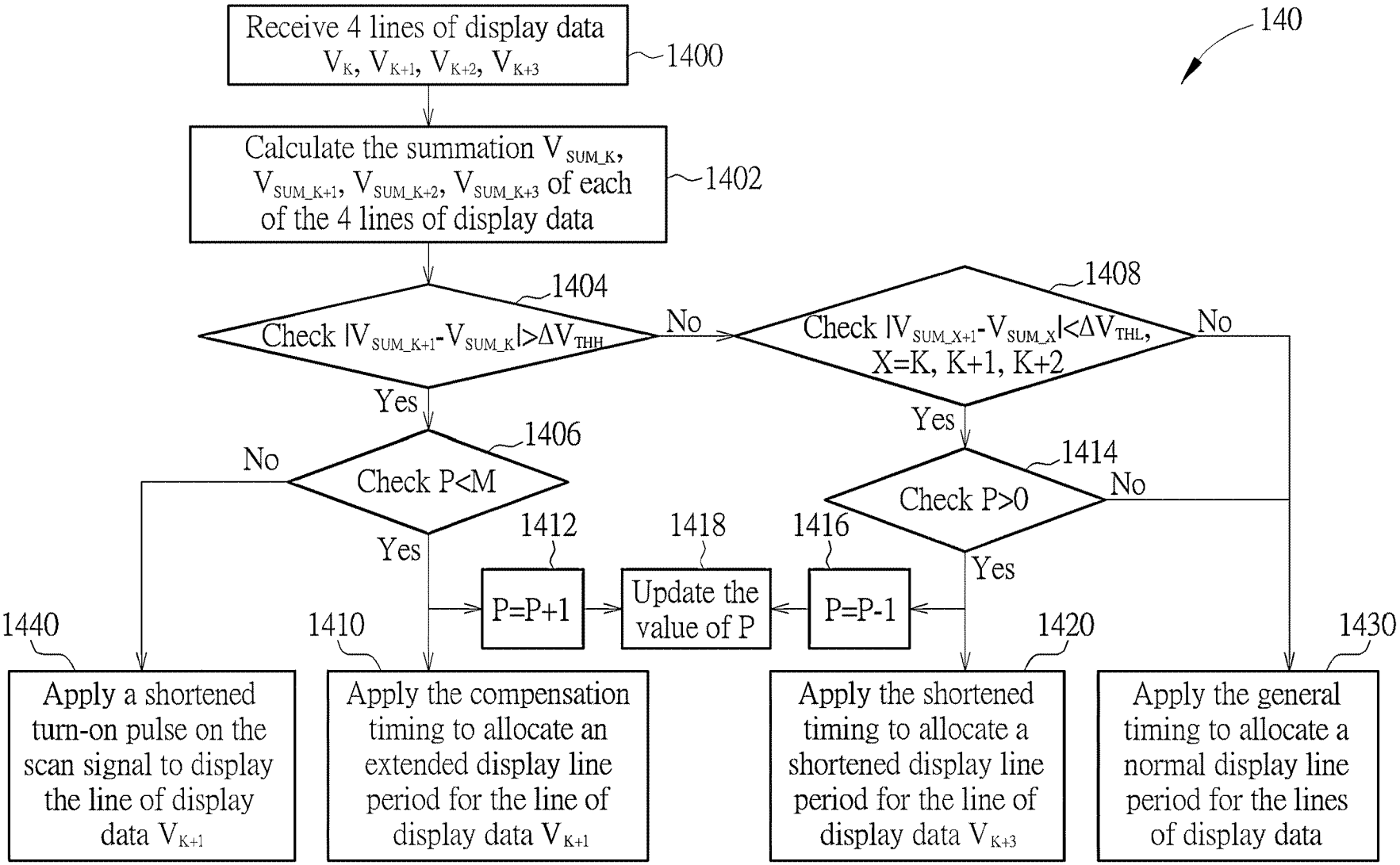
FIG. 14 is a flowchart of another process according to an embodiment of the present invention.

FIG. 14 is a flowchart of another process 140 according to an embodiment of the present invention. The process 140, which may be implemented in a display driver circuit for driving a display panel such as the display driver circuit 402 shown in FIG. 4, includes the following steps:

Step 1400: Receive 4 lines of display data ($V_K$, $V_{K+1}$, $V_{K+2}$, $V_{K+3}$).

Step 1402: Calculate the summation of display data of each of the 4 lines of display data ($V_{sum_K}$, $V_{SUM_K+1}$, $V_{SUM_K+2}$, $V_{SUM_K+3}$).

Step 1404: Determine whether the difference of the summation of a currently received line of display data and the summation of its previous line of display data is greater than a high threshold ($|V_{SUM_K+1}-V_{SUM_K}|<\Delta V_{THH}$). If yes, go to Step 1406; otherwise, go to Step 1408.

Step 1406: Determine whether an extending count P is less than an upper limit M (P<M). If yes, go to Step 1410 and Step 1412; otherwise, go to Step 1440.

Step 1408: Determine whether the difference of the summation of any line of display data in the line buffer and the summation of its previous line of display data is smaller than a low threshold ($|V_{SUM_X+1}-V_{SUM_X}|<\Delta V_{THL}$, X=K, K+1, K+2). If yes, go to Step 1414; otherwise, go to Step 1430.

Step 1410: Apply the compensation timing to allocate an extended display line period for the line of display data $V_{K+1}$.

Step 1412: Increase the extending count P by 1 (P=P+1). Then go to Step 1418.

Step 1414: Determine whether the extending count P is greater than 0. If yes, go to Step 1416 and Step 1420; otherwise, go to Step 1430.

Step 1416: Decrease the extending count P by 1 (P=P−1). Then go to Step 1418.

Step 1418: Update the value of the extending count P.

Step 1420: Apply the shortened timing to allocate a shortened display line period for the line of display data $V_{K+3}$.

Step 1430: Apply the general timing to allocate a normal display line period for the lines of display data.

Step 1440: Apply a shortened turn-on pulse on the scan signal to display the line of display data $V_{K+1}$.

The process 140 describes a line-based operation by determining the output timing based on 4 consecutive lines of display data. As mentioned above, the shortened display line periods in the VFP may not be enough to compensate for the extended timing in the display time. In this embodiment, the shortened display line periods may be included in the display time based on the detection of data difference on several consecutive line data. The shortened display line periods in the display time may improve the flexibility of timing compensation.

In order to handle the timing control appropriately, the display driver circuit may record the extending count P, which indicates the number of extended display line periods minus the number of shortened display line periods that already appears in the current frame period. Step 1404 checks the data difference between the currently received line of display data and its previous line of display data, to determine whether to allocate the extended display line period. The determination is further performed by checking whether the extending count P is less than the upper limit M in Step 1406. The upper limit M may be set to an appropriate value to prevent excessive extended display line periods from influencing the emission behavior (e.g., when the scan signal is delayed too much to overlap the emission time). If an extended display line period is allocated, the value of the extending count P will be increased by 1.

Similarly, if the extending count P is determined to be greater than the upper limit M, the shortened turn-on pulse may be applied on the scan signal to display the line of display data $V_{K+1}$ (Step 1440), such as the implementation shown in FIG. 9.

Step 1408 checks the data difference between every two consecutive lines among the recent 4 lines of display data stored in the line buffer, to determine whether to allocate the shortened display line period. More specifically, the shortened display line period may be allocated if several consecutive line data with low difference are received. The determination is further performed by checking whether the extending count P is greater than 0 in Step 1414. That is, the shortened display line period is required when there is at least one extended display line period that needs to be compensated but has not been compensated in the current frame period. If the shortened display line period is allocated, the value of the extending count P will be decreased by 1.

Please note that the present invention aims at providing a method of controlling the display panel by allocating the output timing determined based on the data difference and/or voltage variations of the display line data. Those skilled in the art may make modifications and alterations accordingly. For example, the processes 130 and 140 merely illustrate exemplary implementations of the present invention. Their detailed operations may be modified or adjusted. For example, the detection of display data may be performed by calculating the grayscale data or measuring the voltage variation generated from the display data. Further, the determination sequence may not need to exactly follow the processes step by step. In the frame-based process 130, the operation of recording the positions of the lines in Step 1308 may be performed before Step 1306 or after Step 1310. In the line-based process 140, the determination is performed based on 4 lines of display data. It can be inferred that similar determination schemes may be applied to 5, 6 or any number of lines of display data recently received.

In addition, the above embodiments are applicable to a display panel having the DDL structure as shown in FIG. 7. In another embodiment, another panel structure may also be applicable. In the display system according to an embodiment of the present invention, the display driver circuit may output control signals to the display panel with the timing allocation having different lengths of display line periods determined based on the data difference or voltage variation, where the detailed structure and connection of the display panel should not be used to limit the scope of the present invention.

To sum up, the present invention provides a method of controlling a display panel used in a display driver circuit. Different from the prior art where the line crosstalk problem is usually solved by using data compensation and modification, the present invention provides a timing compensation scheme to handle the line crosstalk problem. The display driver circuit may detect the data difference and/or voltage variation of several lines of display data, to determine whether to apply the compensation timing or general timing. Under the compensation timing, the length of the display line period may be extended (i.e., to be longer than the length under the general timing). The display driver circuit may thereby output various control signals such as the MUX control signals and/or gate control clocks based on the length of the display line period. In an embodiment, in order to avoid that the delay of scan signals influences the emission behavior, the gate control and emission control may be performed independently by using different timing synchronization signals. The determination process may be performed in a frame-based or line-based manner, to be applicable to the command mode or video mode, respectively. Therefore, when a line of display data has a larger data difference or generates larger voltage variation, the length of display line period may be extended and the output timing of the control signals may be correspondingly adjusted, so as to solve the line crosstalk problem caused by the larger voltage variation on the data lines and thereby improve the visual effects.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of controlling a display panel, comprising:

detecting a plurality of lines of display data to generate a detection result;

determining whether to apply a general timing or a compensation timing to each of the plurality of lines of display data according to the detection result;

allocating a first display line period for a first line of display data among the plurality of lines of display data determined to be applied with the general timing;

outputting at least one control signal to the display panel in the first display line period according to a length of the first display line period;

allocating a second display line period for a second line of display data among the plurality of lines of display data determined to be applied with the compensation timing; and outputting the at least one control signal to the display panel in the second display line period according to a length of the second display line period;

wherein the length of the second display line period is different from the length of the first display line period.

2. The method of claim 1, further comprising:

allocating a third display line period having a length shorter than the length of the first display line period.

3. The method of claim 2, wherein the third display line period is comprised in a vertical front porch of a frame period, wherein the second display line period is comprised in a display time of the frame period.

4. The method of claim 2, further comprising:

detecting a third line of display data after the second line of display data to determine whether to apply a shortened timing to the third line of display data; and allocating the third display line period corresponding to the third line of display data.

5. The method of claim 1, wherein the steps of outputting the at least one control signal to the display panel in the first display line period according to the length of the first display line period and outputting the at least one control signal to the display panel in the second display line period according to the length of the second display line period comprise:

outputting a gate control clock for generating a first scan signal for controlling the first line of display data in the first display line period, wherein the gate control clock has a first pulse corresponding to the first display line period; and outputting the gate control clock for generating a second scan signal for controlling the second line of display data in the second display line period, wherein the gate control clock has a second pulse corresponding to the second display line period;

wherein a width of the second pulse is longer than a width of the first pulse.

6. The method of claim 5, further comprising:

outputting an emission control clock to control an emission of the first line of display data in the first display line period, wherein the emission control clock has a third pulse corresponding to the first display line period; and outputting the emission control clock to control an emission of the second line of display data in the second display line period, wherein the emission control clock has a fourth pulse corresponding to the second display line period;

wherein a width of the fourth pulse is substantially equal to a width of the third pulse.

7. The method of claim 1, wherein the display panel is controlled by a plurality of switches of a multiplexer circuit, and the steps of outputting the at least one control signal to the display panel in the first display line period according to the length of the first display line period and outputting the at least one control signal to the display panel in the second display line period according to the length of the second display line period comprise:

outputting a first multiplexer control signal to turn on a first switch among the plurality of switches for controlling the first line of display data in the first display line period, wherein the first multiplexer control signal has a first delay time; and outputting a second multiplexer control signal to turn on a second switch among the plurality of switches for controlling the second line of display data in the second display line period, wherein the second multiplexer control signal has a second delay time longer than the first delay time.

8. The method of claim 7, wherein the second delay time allows the second multiplexer control signal to turn on the second switch after a gate line for a previous line of display data previous to the second line of display data is turned off.

9. The method of claim 1, wherein the plurality of lines of display data are a frame of display data, and the method further comprises:

calculating a number of lines of display data among the frame of display data determined to be applied with the compensation timing; and allocating the second display line period of which the length is longer than the length of the first display line period when the number of lines of display data determined to be applied with the compensation timing is less than a threshold.

10. The method of claim 9, further comprising:

outputting a gate control clock to generate a shortened turn-on pulse on a scan signal when the number of lines of display data determined to be applied with the compensation timing is greater than the threshold.

11. The method of claim 1, wherein the length of the second display line period is longer than the length of the first display line period.

12. The method of claim 1, wherein the first display line period and the second display line period are comprised in the same frame period of the display panel.

13. The method of claim 1, wherein the steps of detecting the plurality of lines of display data to generate the detection result and determining whether to apply the general timing or the compensation timing to each of the plurality of lines of display data comprise:

detecting a voltage variation generated by each of the plurality of lines of display data; and determining to apply the compensation timing to one of the plurality of lines of display data when the voltage variation generated by the one of the plurality of lines of display data is greater than a threshold.

14. The method of claim 1, wherein the steps of detecting the plurality of lines of display data to generate the detection result and determining whether to apply the general timing or the compensation timing to each of the plurality of lines of display data comprise:

calculating a data difference between each of the plurality of lines of display data and an adjacent line of display data; and determining to apply the compensation timing to one of the plurality of lines of display data when the data difference corresponding to the one of the plurality of lines of display data is greater than a threshold.

15. The method of claim 1, wherein the first display line period and the second display line period are controlled by a horizontal synchronization signal.

16. A display driver circuit for controlling a display panel, comprising:

a pattern detector, configured to detect a plurality of lines of display data to generate a detection result; and a signal generator, configured to:

determine whether to apply a general timing or a compensation timing to each of the plurality of lines of display data according to the detection result;

allocate a first display line period for a first line of display data among the plurality of lines of display data determined to be applied with the general timing;

output at least one control signal to the display panel in the first display line period according to a length of the first display line period;

allocate a second display line period for a second line of display data among the plurality of lines of display data determined to be applied with the compensation timing; and output the at least one control signal to the display panel in the second display line period according to a length of the second display line period;

wherein the length of the second display line period is different from the length of the first display line period.

17. The display driver circuit of claim 16, wherein the signal generator is further configured to:

allocate a third display line period having a length shorter than the length of the first display line period.

18. The display driver circuit of claim 17, wherein the third display line period is comprised in a vertical front porch of a frame period, wherein the second display line period is comprised in a display time of the frame period.

19. The display driver circuit of claim 17, wherein the pattern detector is further configured to detect a third line of display data after the second line of display data to determine whether to apply a shortened timing to the third line of display data, and the signal generator is further configured to allocate the third display line period corresponding to the third line of display data.

20. The display driver circuit of claim 16, wherein the signal generator is configured to output the at least one control signal by performing the following steps:

outputting a gate control clock for generating a first scan signal for controlling the first line of display data in the first display line period, wherein the gate control clock has a first pulse corresponding to the first display line period; and outputting the gate control clock for generating a second scan signal for controlling the second line of display data in the second display line period, wherein the gate control clock has a second pulse corresponding to the second display line period;

wherein a width of the second pulse is longer than a width of the first pulse.

21. The display driver circuit of claim 20, wherein the signal generator is further configured to:

output an emission control clock to control an emission of the first line of display data in the first display line period, wherein the emission control clock has a third pulse corresponding to the first display line period; and output the emission control clock to control an emission of the second line of display data in the second display line period, wherein the emission control clock has a fourth pulse corresponding to the second display line period;

wherein a width of the fourth pulse is substantially equal to a width of the third pulse.

22. The display driver circuit of claim 16, wherein the display panel is controlled by a plurality of switches of a multiplexer circuit, and the signal generator is configured to output the at least one control signal by performing the following steps:

outputting a first multiplexer control signal to turn on a first switch among the plurality of switches for controlling the first line of display data in the first display line period, wherein the first multiplexer control signal has a first delay time; and outputting a second multiplexer control signal to turn on a second switch among the plurality of switches for controlling the second line of display data in the second display line period, wherein the second multiplexer control signal has a second delay time longer than the first delay time.

23. The display driver circuit of claim 22, wherein the second delay time allows the second multiplexer control signal to turn on the second switch after a gate line for a previous line of display data previous to the second line of display data is turned off.

24. The display driver circuit of claim 16, wherein the plurality of lines of display data are a frame of display data, and the signal generator is further configured to:

calculate a number of lines of display data among the frame of display data determined to be applied with the compensation timing; and allocate the second display line period of which the length is longer than the length of the first display line period when the number of lines of display data determined to be applied with the compensation timing is less than a threshold.

25. The display driver circuit of claim 24, wherein the signal generator is further configured to:

output a gate control clock to generate a shortened turn-on pulse on a scan signal when the number of lines of display data determined to be applied with the compensation timing is greater than the threshold.

26. The display driver circuit of claim 16, wherein the length of the second display line period is longer than the length of the first display line period.

27. The display driver circuit of claim 16, wherein the first display line period and the second display line period are comprised in the same frame period of the display panel.

28. The display driver circuit of claim 16, wherein the pattern detector is configured to detect the plurality of lines of display data and determine whether to apply the general timing or the compensation timing by performing the following steps:

detecting a voltage variation generated by each of the plurality of lines of display data; and determining to apply the compensation timing to one of the plurality of lines of display data when the voltage variation generated by the one of the plurality of lines of display data is greater than a threshold.

29. The display driver circuit of claim 16, wherein the pattern detector is configured to detect the plurality of lines of display data and determine whether to apply the general timing or the compensation timing by performing the following steps:

calculating a data difference between each of the plurality of lines of display data and an adjacent line of display data; and determining to apply the compensation timing to one of the plurality of lines of display data when the data difference corresponding to the one of the plurality of lines of display data is greater than a threshold.

30. The display driver circuit of claim 16, wherein the first display line period and the second display line period are controlled by a horizontal synchronization signal.

* * * * *